US009823037B1

(12) United States Patent
Lowrance

(10) Patent No.: US 9,823,037 B1
(45) Date of Patent: Nov. 21, 2017

(54) AMMUNITION BELT CAPTURE AND RELEASE MECHANISM AND METHOD FOR AN IMITATION MACHINE GUN

(71) Applicant: Pathfinder Systems, Inc., Arvada, CO (US)

(72) Inventor: Kyle Lowrance, Westminster, CO (US)

(73) Assignee: Pathfinder Systems, Inc., Lakewood, CO (US)

( * ) Notice: Subject to any disclaimer, the term of this patent is extended or adjusted under 35 U.S.C. 154(b) by 573 days.

(21) Appl. No.: 14/542,005

(22) Filed: Nov. 14, 2014

(51) Int. Cl.
*F41A 33/00* (2006.01)

(52) U.S. Cl.
CPC ..... *F41A 33/00* (2013.01)

(58) Field of Classification Search
CPC .. F41A 33/00; F41A 33/06; F41A 9/79; F41A 9/29; B64D 7/02; F41G 3/26; F41F 1/10
See application file for complete search history.

(56) References Cited

U.S. PATENT DOCUMENTS

| | | | | |
|---|---|---|---|---|
| 8,690,575 | B1 * | 4/2014 | Gurule | F41A 33/06 434/11 |
| 2010/0294119 | A1 * | 11/2010 | Buechler | B64D 7/06 89/33.2 |
| 2012/0048101 | A1 * | 3/2012 | Shirts | F41A 9/29 89/33.2 |
| 2016/0146563 | A1 * | 5/2016 | Garvis | F41A 33/00 434/16 |

* cited by examiner

*Primary Examiner* — Benjamin P Lee
(74) *Attorney, Agent, or Firm* — Dorr, Carson & Birney PC

(57) ABSTRACT

A simulated ammunition belt is captured in and released from a feedway of an imitation machine gun by selectively extending and retracting a retaining projection into the space between adjacent simulated rounds of the ammunition belt. The retaining projection is operably connected to a cover of the gun housing and is concealed within the housing when the cover is closed.

21 Claims, 11 Drawing Sheets

AMMUNITION BELT CAPTURE AND RELEASE MECHANISM AND METHOD FOR AN IMITATION MACHINE GUN

CROSS REFERENCE TO RELATED APPLICATIONS

This invention is related to an invention for a Recoil Simulator and Method for an Imitation Machine Gun, described in U.S. patent application Ser. No. 14/541,515, filed concurrently herewith, now U.S. Pat. No. 9,746,273, issued on Aug. 29, 2017; and to an invention for a Bolt Capture and Release Mechanism and Method for an Imitation Machine Gun, described in U.S. patent application Ser. No. 14/541,559, filed concurrently herewith. Both of these applications are assigned to the assignee of the present invention. The subject matter of these applications is incorporated herein fully by this reference.

FIELD OF THE INVENTION

This invention relates generally to training persons to operate an actual machine gun by using an imitation or simulated machine gun. More particularly, the present invention relates to a new and improved ammunition belt capture and release mechanism and method which reliably simulates, with the imitation machine gun during training, the requirement to load an actual ammunition belt to enable continued use of the machine gun.

BACKGROUND OF THE INVENTION

In modern circumstances, it is difficult and expensive to train soldiers and military defense personnel in the effective use of high-powered rapid-fire machine guns, by simply allowing such individuals to practice using the actual guns with live ammunition. The ammunition rounds are expensive, for example costing up to five dollars per round. The cost of ammunition alone quickly multiplies when it is recognized that a typical machine gun is capable of firing hundreds of rounds per minute. Adequate space for a practice gunnery range may not be readily available. Increased cost is involved in transporting the personnel and the equipment to suitable remote locations where adequate gunnery practice can be performed. Safety is always a major consideration when live ammunition rounds are fired, both to military personnel involved in gunnery practice and to non-military personnel who may be adjacent to the gunnery range. It is difficult to instruct during a live ammunition training session due to the noise and safety considerations involved when others are involved in similar, close-by, live-ammunition practice activities. Furthermore, it may be difficult to vary the targets quickly at a live-ammunition gunnery range.

These problems and practical constraints are exacerbated when training individuals to shoot from a moving vehicle such as a helicopter. If live ammunition practice is attempted from a moving helicopter, a large space is required in order to maneuver the helicopter and to provide targets and adequate safety barriers, especially when multiple individuals are involved in similar simultaneous training exercises. As a result, live gun practice requires considerabe space, and the cost of operating the helicopter greatly multiplies the overall training cost.

Because of these and other considerations, simulated weapon training programs have been developed for teaching purposes. Such training programs use imitation machine guns which closely simulate the sensational aspects and the mechanical and physical requirements of firing actual machine guns. Firing is simulated by reproducing effects which mirror the sensual perceptions associated with firing the actual machine gun. The environment and the targets are electronically displayed, allowing them to be more easily varied and to simulate movement of the targets and the machine gun. The trajectory of the simulated bullet fired is also calculated. In those cases where the simulated fired bullet emulates a tracer, the trajectory of that simulated bullet is also displayed in the surrounding environment.

For helicopter gun training, the imitation machine gun is mounted in an open door of an imitation portion of the helicopter fuselage. The environment and the targets are displayed outside of the open door. The portion of the imitation helicopter fuselage is moved or shaken in a manner similar to the movement of an actual helicopter in flight while the display of the surrounding environment and the targets are moved to simulate the flight path of the helicopter.

Simulated weapons training programs offer other benefits. Environments of remote areas of the world may be simulated, thereby providing training exposure to such environments prior to actually deploying the military personnel to those locales. The accuracy of the training program and the abilities of the individuals trained may be assessed. The accuracy in shooting, and the success of the training itself, is gauged by comparing the calculated, projected trajectory of the simulated bullets relative to the displayed targets. The number of simulated rounds fired may also be counted to evaluate the efficiency of the individual doing the shooting. Other factors can be evaluated from the vast amount of information available from such computer-based simulated weapons training programs.

Of course, to be effective for training purposes, it is necessary to create a realistic simulated environment and a realistic experience of firing the imitation machine gun. Such simulation is accomplished principally by multiple computer systems which are programmed to perform their specific simulation activities in coordination with each other. In the end, the capability of the simulated weapons training program to imitate the actual use of the actual machine gun in an actual environment is the ultimate measure of effective and successful training.

Individuals become accustomed to the imitation machine gun due to the amount of simulated training received. Because of the familiarity gained from training with the imitation machine gun, use of the imitation machine gun should be essentially the same as the use of the actual machine gun; otherwise, differences in functionality or performance create unexpected problems or difficulties when using the actual machine gun.

One action which must be trained to accurately simulate the use of an actual machine gun is loading an ammunition belt into the machine gun. Ammunition is supplied to the machine gun from an ammunition belt. To commence firing, the ammunition belt must be properly loaded into the machine gun. Each ammunition belt has a predetermined number of rounds, and when that number of rounds has been fired, it is necessary to load a new ammunition belt to continue firing. During intensive use, it is necessary to repetitively load ammunition belts, and do so quickly. Effective training with an imitation machine gun therefore requires the user to load ammunition belts, and do so on a repetitive and intensive basis.

To load an ammunition belt in an actual machine gun, a cover at the top of a housing of the machine gun is opened to expose a feed tray which pivots slightly upward when the cover is opened. An ammunition box which contains the ammunition belt is placed on a support tray which extends from the side of the machine gun. A door on the top of the ammunition box is opened, and the leading end of the ammunition belt is withdrawn from the open ammunition box. The leading rounds of the ammunition belt are placed on the feed tray, and the cover is then closed over the ammunition belt. The leading rounds of the ammunition belt are thereby positioned within an ammunition belt feedway of the machine gun to interact with a bolt of the machine gun.

To commence firing an actual machine gun, the bolt must be "charged" by manually pulling a charging handle rearwardly. Charging the bolt moves the bolt rearward against the force of an internal bolt actuating spring. Charging the bolt also removes the first round from the ammunition belt, moves the removed round into position on the bolt, and when the trigger is pulled enables the compressed bolt actuating spring to drive the bolt forward to load the round into a firing chamber and then fire that loaded round. The explosive force from firing the round drives the bolt rearward against the force of the bolt actuating spring. The rearward movement of the bolt automatically ejects the spent casing, withdraws the next live round from the ammunition belt, expels a connection link which joined the withdrawn round to the next round of the ammunition belt, positions the withdrawn round on the bolt for loading and firing, and advances the ammunition belt to locate the next round to undergo similar actions after active round has been fired. This sequence of events repeats with each subsequent pull of the trigger, or repeats automatically while the trigger remains depressed.

Unlike an actual machine gun, the imitation machine gun does not reciprocate the bolt, eject simulated casings, expel belt connecting links, or advance the next simulated round from the simulated ammunition belt. However, the imitation machine gun does require charging the bolt to enable the simulated firing of the first simulated round of a newly-loaded simulated ammunition belt. The bolt is held in the charged position against the force of the compressed bolt actuating spring while simulated rounds are fired. A recoil simulation device creates recoil impacts which simulate firing each ammunition round and the reciprocating motion of the bolt in an actual machine gun, by shaking or reciprocating the imitation machine gun in a forward and backward motion. One very effective recoil simulation device is described in the first above-referenced US patent application.

After all of the predetermined number of rounds of an actual ammunition belt have been fired simulatively from the imitation machine gun, as determined by counting the number of recoil impacts generated by the recoil simulation device, a bolt capture and release mechanism releases the bolt to allow the compressed bolt actuating spring to drive the bolt forward, thereby placing the bolt in position for charging after another ammunition belt has been loaded. One very effective bolt capture and release mechanism is described in the second above-referenced US patent application.

Simultaneously with the release of the bolt, an ammunition belt capture and release mechanism releases the simulated ammunition belt from the ammunition belt feedway of the imitation machine gun. A spring attached to the trailing end of the simulated ammunition belt withdraws the released simulated ammunition belt from the feedway and returns the entire simulated ammunition belt back into the open ammunition box. In the actual machine gun, firing all the rounds of the ammunition belt consumes the belt so that it no longer exists when the last round is fired. In the simulated machine gun, the simulated ammunition belt is withdrawn into the ammunition box when the last simulated round is fired. In both the imitation and actual machine guns, loading a new ammunition belt is required to continue firing.

One known device for capturing and releasing a simulated ammunition belt in an imitation machine gun uses a solenoid with a fork-like member connected to an armature of the solenoid. A compression spring surrounds the armature and forces the fork-like member to project into the space between two adjacent ammunition rounds in the simulated ammunition belt, thereby holding the simulated ammunition belt in the ammunition belt feedway. The force from the compression spring must hold the fork-like member between the two adjacent ammunition rounds under the influence of the repetitive impacts created by the recoil simulation device. However, in the previous device, the vibration from the recoil impacts gradually separates the fork-like member from within the space between the two rounds, causing a premature release of the simulated ammunition belt.

If the force from the compression spring is increased to maintain the fork-like member between the two rounds of the simulated ammunition belt under the influence of the recoil impacts, the solenoid must generate enough force to overcome the force from the compression spring to release the simulated ammunition belt when all the simulated rounds have been fired. A solenoid capable of generating sufficient force to overcome the force from the compression spring is physically large in size. Such a solenoid is too large to be integrated within the housing of the imitation machine gun without interfering with the other internal components of the imitation machine gun, such as the bolt. Consequently, the large solenoid of the prior art ammunition belt capture and release mechanism is attached to the exterior of the housing of the imitation machine gun at a position adjacent to the ammunition belt feedway.

Locating the prior art ammunition belt capture and release mechanism on the exterior of the housing of the imitation machine gun creates mechanical and use differences between the actual and simulated machine guns. The actions required to load the simulated ammunition belt in the simulated machine gun are different from the actions required to load the actual ammunition belt in the actual machine gun. In an actual machine gun, the ammunition belt is retained in the ammunition belt feedway by internal devices within the housing of the machine gun after the cover has been closed. In the imitation machine gun, the user must assure that the ammunition belt is properly located relative to the exterior mechanism. The user must also assure that the simulated ammunition belt continues to interact properly with the fork-like member connected to the solenoid armature, such as by occasionally repositioning, holding or manipulating the simulated ammunition belt. Such dissimilarities between the imitation and actual machine guns increase the risk of incorrectly and inefficiently loading actual ammunition belts when using the actual machine gun, and also detract from effective training due to the additional actions required to manipulate the simulated ammunition belt that are not required when using an actual machine gun.

A prior art ammunition belt capture and release mechanism with a less forceful compression spring and solenoid typically releases the simulated ammunition belt prematurely, which also causes dissimilarities between training and actual use, because the operator of the imitation machine gun is required to re-load the ammunition belt on a more frequent or erratic basis than would be the case if using an actual machine gun. Further still, the premature release of the ammunition belt has the potential to adversely influence the computer system which anticipates firing the full number of simulated rounds of the simulated ammunition belt. A premature release of the simulated ammunition belt also has the potential of adversely impacting the coordination between the other computer systems of the training simulator, thereby disrupting or detracting from the entire training experience.

SUMMARY OF THE INVENTION

The present invention overcomes the problems of an exteriorly-mounted prior art ammunition belt capture and release mechanism in an imitation machine gun. The capture and release mechanism of the present invention is integrated within the housing of the imitation machine gun, thereby allowing the user to interact with the imitation machine gun when loading a simulated ammunition belt in essentially the same way that interaction is required in an actual machine gun. The simulated ammunition belt is reliably retained in the ammunition belt feedway under the influence of the repetitive impacts generated by a recoil mechanism of the imitation machine gun, thereby preventing premature and the erratic releases of the simulated ammunition belt. The full number of rounds of the simulated ammunition belt can be fired simulatively before it becomes necessary to load another ammunition belt. The user is not required to direct his or her attention to maintaining the simulated ammunition belt in the exterior capture and release mechanism but instead can concentrate effectively on learning to accurately fire a machine gun. In addition, the present invention avoids a loss of coordination among the control systems of the training simulator that otherwise might result from a premature and erratic releases of the simulated ammunition belt during training. As a consequence of the present invention, the training with the imitation machine gun is more effective, and the individuals trained are more capable of properly and effectively operating the actual machine gun in actual circumstances.

In accordance with the above described and other related considerations, the ammunition belt capture and release mechanism of the present invention is used in an imitation machine gun which has a housing defining an ammunition belt feedway into which simulated rounds of a simulated ammunition belt are loaded when using the gun. The rounds of the simulated ammunition belt are retained in a parallel relationship in the belt with spaces between adjacent rounds. The housing of the imitation machine gun includes a cover which is moved to an open position to permit access into the feedway for loading the simulated ammunition belt. The ammunition belt capture and release mechanism is attached to the cover and moves into a position adjacent to the leading rounds of the simulated ammunition belt in the feedway when the cover is closed to confine the leading rounds of the ammunition belt in the feedway. The ammunition belt capture and release mechanism comprises a retaining projection which is selectively movable into an extended position into the space between two adjacent rounds of the simulated ammunition belt in the feedway to retain the simulated ammunition belt in the feedway when the cover is closed. The retaining projection is also selectively movable into a retracted position where the retaining projection is withdrawn from the space between the two adjacent rounds to release the simulated ammunition belt from the feedway when the predetermined number of rounds have been fired simulatively. The ammunition belt capture and release mechanism is substantially concealed within the housing when the cover is closed.

Certain subsidiary features of the ammunition belt capture and release mechanism include some or all of the following. A solenoid operatively moves the retaining projection into the extended and retracted positions. The retaining projection extends from an elongated holding pawl. The holding pawl has a first end pivotally connected at a stationary position to permit pivoting movement of the holding pawl with the second end of the holding pawl moving in an arc about the first end when the holding pawl pivots. A movably positioned ramp has an inclined surface which interacts in a cam-like manner with the second end of the holding pawl to pivot the holding pawl and move the retaining projection between the extended and retracted positions. The ramp includes a flat surface extending from the inclined surface. The flat surface interacts with the second end of the holding pawl to maintain the retaining projection in the extended position. First and second elongated linkage arms are pivotally connected to one another and are operatively connected between a casing and the ramp for moving the ramp relative to the second end of the holding pawl to achieve the extended and retracted positions. The first and second linkage arms are biased to pivot into substantial alignment with one another to move a flat surface of the ramp relative to the second end of the holding pawl to establish the retaining projection in the extended position. The solenoid or other motive power source interacts with the first and second linkage arms to pivot them into an angular orientation with respect to one another to move the inclined surface of the ramp relative to the second end of the holding pawl to pivot the holding pawl and retract the retaining projection, thereby releasing the simulated ammunition belt.

The invention also involves a method of selectively capturing a simulated ammunition belt loaded into an ammunition belt feedway of an imitation machine gun and selectively releasing the simulated ammunition belt from the feedway during use of the gun. The simulated ammunition belt retains the simulated ammunition rounds in a parallel relationship in the belt with spaces between adjacent rounds. The feedway extends into a housing of the gun. The housing includes a cover which is movable to an open position to permit access into the feedway for loading the simulated ammunition belt, and the cover is moveable to a closed position when the gun is used. The method involves attaching a retaining projection to the cover in a position to be substantially concealed within the housing when the cover is in the closed position, extending the retaining projection into the space between two adjacent rounds of the simulated ammunition belt loaded into the feedway when the cover is in the closed position to capture the simulated ammunition belt within the feedway, and retracting the retaining projection from the space between the two adjacent rounds of the simulated ammunition belt to release the simulated ammunition belt from the feedway when the cover is in the closed position.

Certain subsidiary features of the method includes some or all of the following: extending the retaining projection from a holding pawl and pivotally connecting the holding pawl relative to the cover and pivoting the holding pawl to extend and retract the retaining projection; pivotally connecting a first end of the holding pawl at a stationary position relative to the cover, and camming an opposite second end of the holding pawl to extend and retract the retaining projection; camming the second end of the holding pawl by moving a ramp relative to the cover with the second end of the holding pawl interacting with an inclined surface of the ramp; interacting a flat surface of the ramp which extends from the inclined surface with the second end of the holding pawl to maintain the retaining projection in the extended position; pivotally connecting first and second elongated first linkage arms to operatively cam the second end of the holding pawl; and pivoting the first and second linkage arms into substantial alignment with one another to extend the retaining projection and pivoting the first and second linkage arms into an angular orientation with respect to one another to retract the retaining projection.

Other aspects and features of the invention, and a more complete appreciation of the present invention, as well as the manner in which the present invention achieves the above and other improvements and benefits, can be obtained by reference to the following detailed description of a presently preferred embodiment of the invention taken in connection with the accompanying drawings which are briefly summarized below, and by reference to the appended claims.

DETAILED DESCRIPTION

Figure 1:
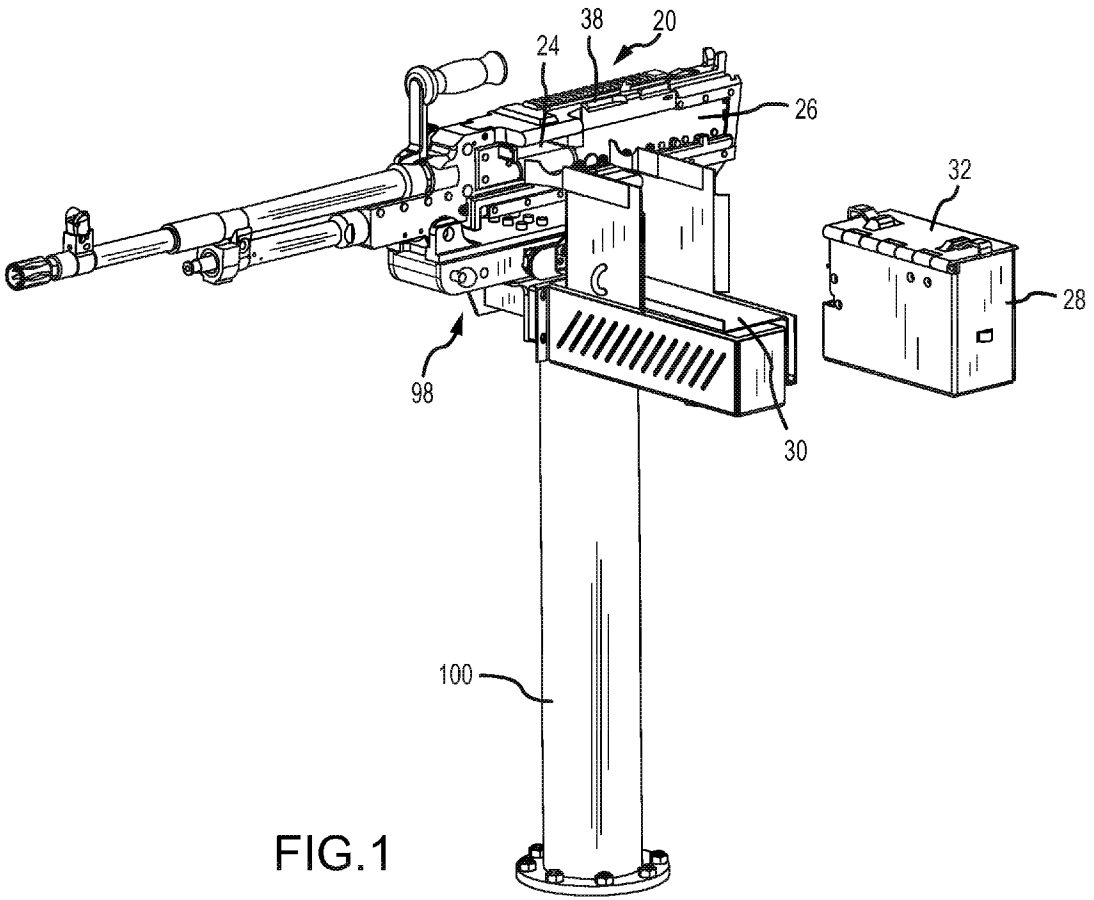
FIG. 1 is a generalized perspective view of an exemplary imitation machine gun which incorporates an ammunition belt capture and release mechanism, and which exemplifies a method of selectively capturing and releasing a simulated ammunition belt in an imitation machine gun, according to the present invention.
Figure 2:
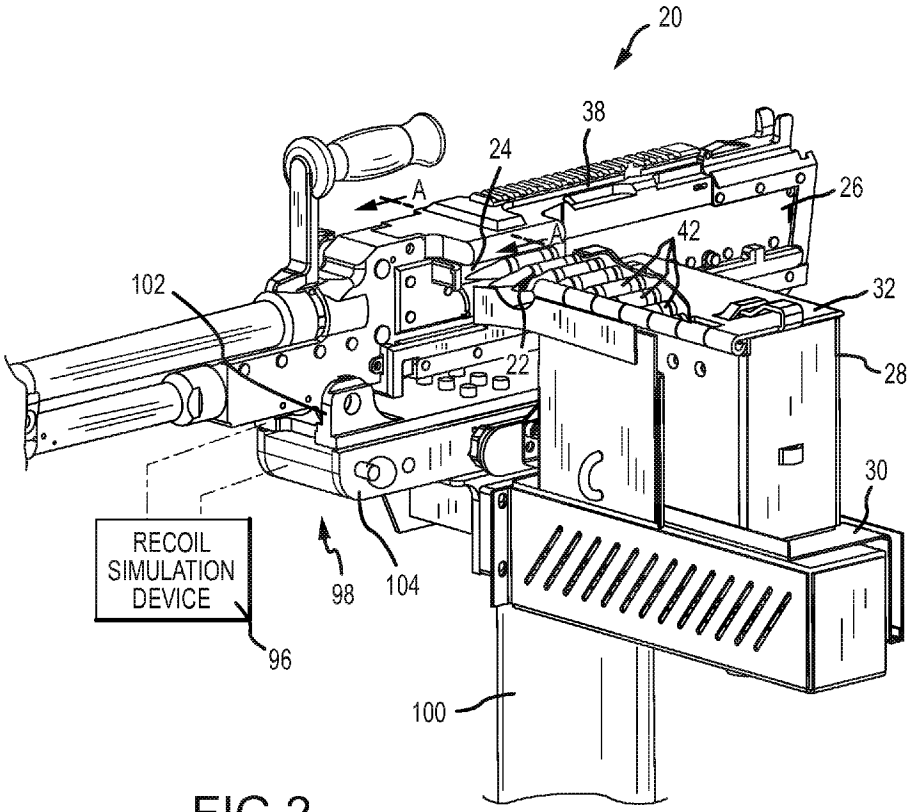
FIG. 2 is an enlarged partial view of the imitation machine gun shown in FIG. 1, illustrating a simulated ammunition belt loaded into a feedway of the imitation machine gun with the ammunition belt extending from an ammunition box.

An imitation machine gun 20 which is used in simulated weapons training activities is shown in FIGS. 1 and 2. The machine gun 20 duplicates the look and feel and the mechanical features of an actual machine gun which it imitates. To use the imitation machine gun 20 by firing it in a stimulative manner, the operator must load a simulated ammunition belt 22 into an ammunition belt feedway 24 of a housing 26 of the gun 20. The ammunition belt 22 is withdrawn from an ammunition box 28 which is placed on a support tray 30. The support tray 30 extends transversely from the housing 26 of the gun 20 at a position below the feedway 24. The ammunition box 28 includes an upper door 32, which when opened, permits the ammunition belt 22 to be withdrawn from the interior of the box 28 and extended into the feedway 24.

After all of the predetermined number of rounds of the ammunition belt 22 have been fired stimulatively, an ammunition belt capture and release mechanism 34 (FIGS. 3 and 6-12) releases the simulated ammunition belt 22 from within the feedway 24, and the simulated ammunition belt 22 is retracted into the ammunition box 28 by a spring 36 (FIG. 5) located within the ammunition box 28. With the simulated ammunition belt 22 released and removed from the feedway 24, the feedway is unoccupied just as when all of the actual rounds of an actual ammunition belt have been consumed by firing an actual machine gun.

To continue firing the imitation machine gun 20, the operator must load the simulated ammunition belt 22, either from the same ammunition box 28 or from a replacement ammunition box 28. Loading the simulated ammunition belt is accomplished by the actions understood from FIGS. 2 and 3. The used ammunition box 28 is removed from the support tray 30, and a new ammunition box 28 is placed on the support tray 30. An upper cover 38 of the housing 30 is pivoted open to provide upper access into the feedway 24. A feed tray 40 of the gun 20 defines the bottom of the feedway 24 and supports the ammunition belt 22 when located in the feedway 24. The feed tray 40 pivots slightly upward when the upper cover 38 of the housing 30 is pivoted open. The upper door 32 of the new ammunition box 28 is opened, and the leading end portion of the ammunition belt 22 is removed from the interior of the ammunition box. The first few rounds 42 of the leading end of the ammunition belt 22 are placed on the feed tray 40. A locator ridge 44 (FIG. 3) extends upward from the feed tray 40 to locate the proper position of the first round 42 of the ammunition belt 22 when placed on the feed tray 40. The cover 38 is then closed (FIGS. 1 and 2), as is the upper door 32 of the ammunition box 28.

Figure 3:
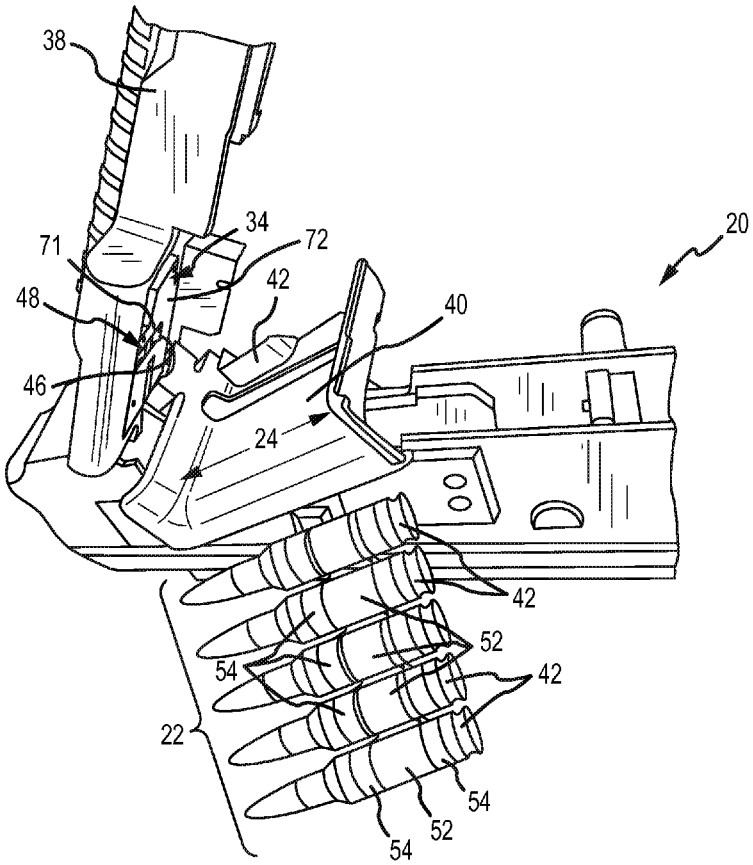
FIG. 3 is an enlarged partial view of the imitation machine gun shown in FIGS. 1 and 2, illustrating an open cover of the imitation machine gun, the ammunition belt capture and release mechanism of the present invention attached to the cover, a feed tray of the imitation machine gun and a leading end portion of a simulated ammunition belt to be loaded into the imitation machine gun.
Figure 7:
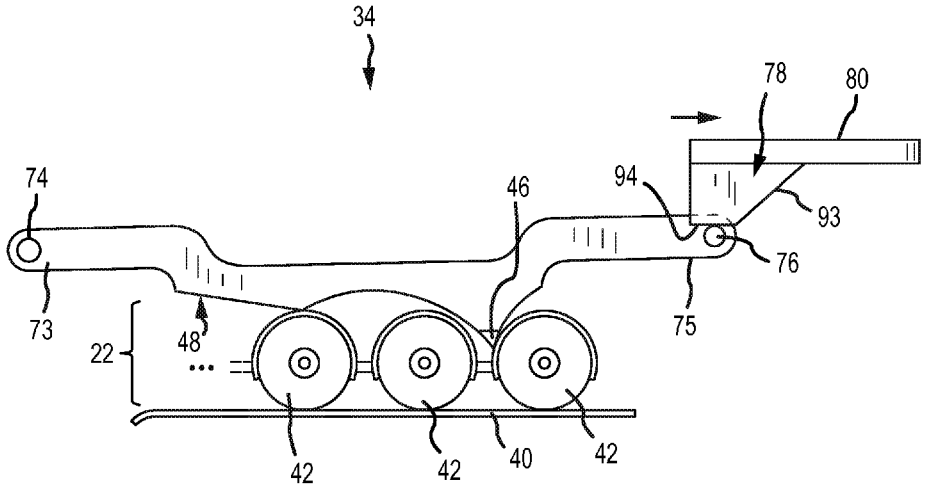
FIG. 7 is a vertical transverse cross-sectional view taken substantially in the plane of line A-A in FIG. 2, showing the position of a holding pawl of the ammunition belt capture and release mechanism shown in FIG. 6 when capturing and holding the simulated ammunition belt.
Figure 10:
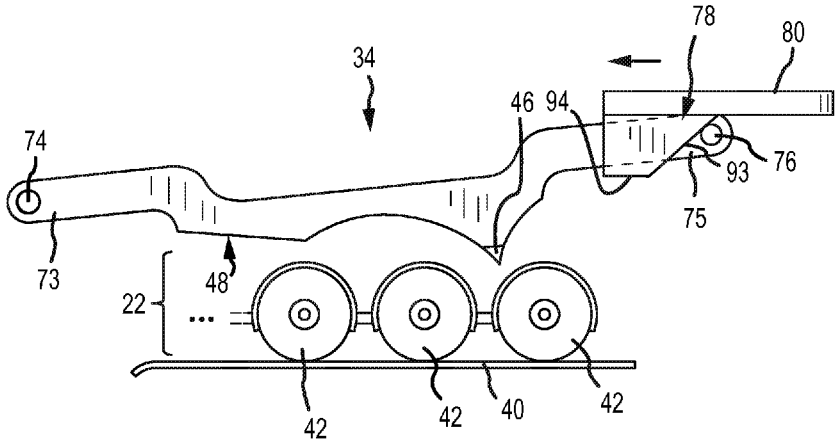
FIG. 10 is a vertical transverse cross-sectional view taken substantially in the plane of line A-A of FIG. 2 and related to FIG. 7, showing the position of the holding pawl of the ammunition belt capture and release mechanism shown in FIG. 6 when releasing the simulated ammunition belt.

The ammunition belt capture and release mechanism 34 is connected to the inside of the cover 38 of the machine gun housing 26 (FIG. 3). The belt capture and release mechanism 34 is in close adjacency with the upper surfaces of the first few rounds 42 of the ammunition belt 22 when the cover 38 is closed (FIGS. 7 and 10). The feed tray 40 contacts the bottom surfaces of the rounds 42 in the feedway 24 (FIGS. 7 and 10). A retaining projection 46 of a holding pawl 48 of the belt capture and release mechanism 34 extends into the space between the first and second leading rounds 42 of the simulated ammunition belt (FIG. 7). The retaining projection 46 prevents movement of the first two rounds of the ammunition belt 22 out of the feedway 24 and thereby holds the belt 22 in the feedway 24. The retaining projection 46 resists the retraction force from the spring 36 (FIG. 5) and prevents the spring 36 from pulling the ammunition belt 22 out of the feedway 24 back into the ammunition box 28.

After all of the predetermined number of ammunition rounds of the simulated ammunition belt 22 have been fired stimulatively, the holding pawl 48 of the ammunition belt capture and release mechanism 34 is pivoted upward to remove the retaining projection 46 from the space between the leading two ammunition rounds in the belt 22 (FIG. 10). With the belt 22 no longer restrained by the retaining projection 46, the spring 36 (FIG. 5) withdraws the belt 22 back into the interior of the ammunition box 28. Under these conditions, the feedway 24 is unoccupied and the user must load another simulated ammunition belt 22 to continue using the gun 20.

Figure 4:
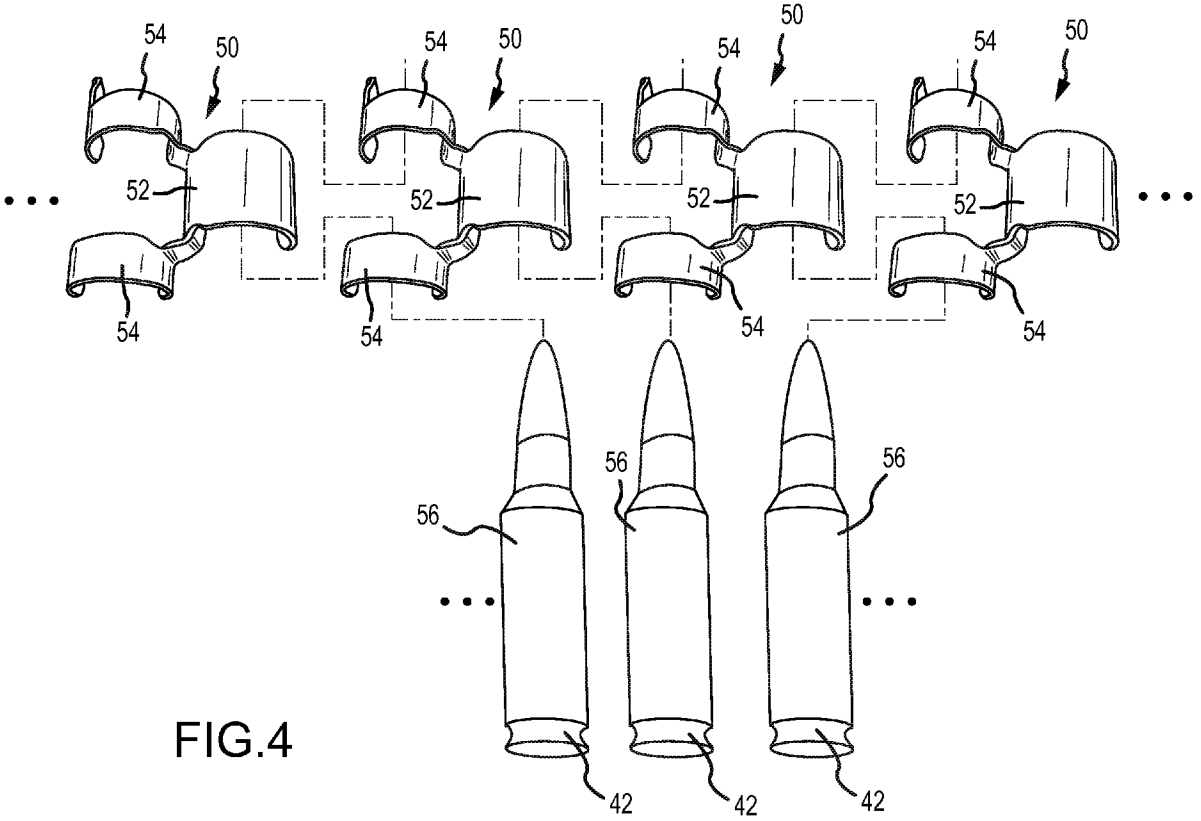
FIG. 4 is an exploded perspective view of three rounds of ammunition and connecting links which hold the ammunition rounds in the simulated ammunition belt shown in FIGS. 2 and 3.

The simulated ammunition belt 22 is formed of simulated rounds 42 which are held together in the belt 22 by belt connection links 50, as shown in FIG. 4. The simulated rounds 42 are the same size as actual ammunition rounds, and the connection links 50 are the same configuration as the connection links used to construct an actual ammunition belt from actual ammunition rounds. Each connection link 50 includes a large center portion 52 which has a circular curvature that extends slightly more than 180° around a casing 56 of one simulated ammunition round 42. Each connection link also includes two relatively narrow end portions 54 that are each positioned slightly to the outside of the center portion 52. Each of the end portions 54 also has a circular curvature which extends slightly more than 180° around the casing 56 of an adjacent simulated round 42. The space between the two end portions 54 accommodates the center portion 52 of an adjacent connection link 50.

The center portion 52 of one connection link 50 clips around a casing 56 of one ammunition round 42, and the two end portions 54 of the same connection link 50 clip around the casing 56 of an adjacent ammunition round 42 in the belt 22. The center portion 52 of another adjacent connection link 50 clips to that same adjacent ammunition round 22, between the two end portions 54 of the one connection clip. This arrangement continues with the center portion 52 of one connection link and the end portions 54 of another adjacent connection link clipped around the casing 56 of each ammunition round 42. In this manner, each connection link 50 connects two adjacent ammunition rounds 42.

A curvature of more than 180° curvature of both the center and end portions 52 and 54 of each connection link 50 around each casing 56 of the ammunition rounds 42 is sufficient to hold each round in place in the belt 22. Because the connection links 50 pivot around the casings 56 to which they are connected, the ammunition belt 22 will bend. Bending in this manner allows an actual ammunition belt to be folded in a serpentine manner within an actual ammunition box 28, thereby consuming essentially all of the interior of the box 28. The bending capability allows the actual ammunition belt to occur from the ammunition box 28 into the feedway 24 and two straighten as it passes through the feedway of the actual machine gun.

The ammunition box 28 used with the imitation machine gun 20 is the actual size of an actual ammunition box used with an actual machine gun. However, the simulated ammunition belt 22 is only of a limited length necessary to extend from the ammunition box 28 into the belt feedway 24. The details of the simulated ammunition belt 22 and the characteristics of the ammunition box 28 used with the belt 22 are described in connection with FIG. 5. The number of simulated rounds 42 in the simulated ammunition belt 22 is considerably less than the number of actual rounds in an actual ammunition belt. For example, the simulated ammunition belt has about 15 to 20 simulated rounds 42 connected by the connection links 50 (FIG. 4). The trailing end simulated round 42 in the belt 22 is connected to the spring 36.

Figure 5:
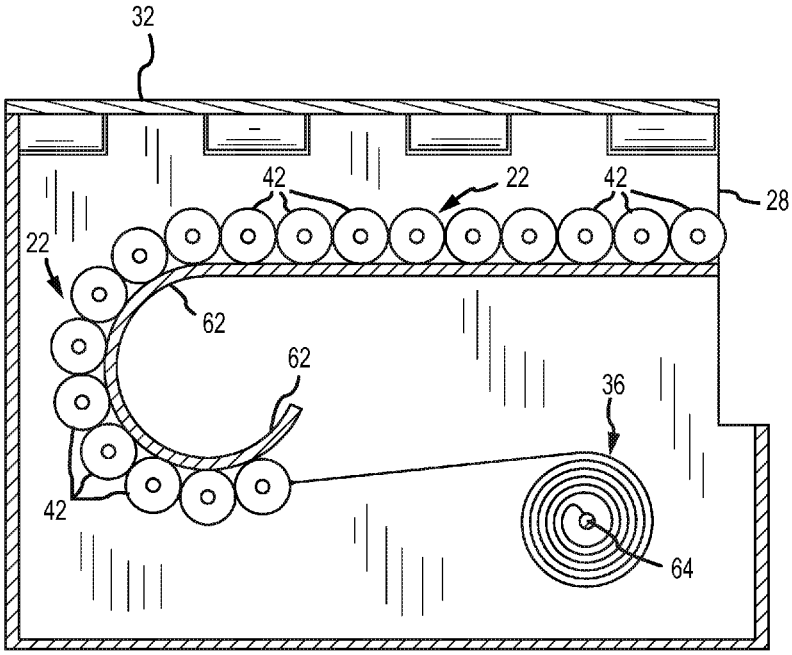
FIG. 5 is a vertical section view of the ammunition box shown in FIG. 2, illustrating the simulated ammunition belt and a spring which biases the ammunition belt toward a retracted position within the ammunition box.

A curved wall 62 is attached within the interior of the ammunition box 28. The curved wall 62 extends between opposite side walls of the box 28. The spring 36 is a conventional constant force spring, formed by helically coiling spring material. The spring 36 is attached at one end to a post 64 which extends transversely across the interior of the box 28 at the opposite end of the box from the curved wall 62. The coils of the spring 36 are helically concentric with one another and surround the post 64. The other end of the spring 36 is connected to the connection link 50 clipped to the last round 42 in the simulated ammunition belt 22. When the simulated ammunition belt 22 is contained entirely within the ammunition box 28, as shown in FIG. 5, the spring 36 pulls the ammunition rounds 42 into contact with the curved wall 62. When the leading rounds 42 of the simulated ammunition belt 22 are withdrawn from the ammunition box 28, the spring 36 is extended as a result of pulling the leading end of the belt 22 from the box 28 and extending the belt into the feedway 24 of the gun 20 (FIG. 2). In this circumstance the spring 36 extends partially along the curved wall 62 as the leading part of the leading part of the belt 22 extends from the box 28. When the ammunition belt capture and release mechanism 34 releases the ammunition belt (FIGS. 10-12), force from the extended spring 36 pulls the simulated rounds 42 of the belt 22 into the interior of the ammunition box 28.

More details of the ammunition belt capture and release mechanism 34 are understood by reference to FIGS. 6-12. The mechanism 34 is housed within a case 70. The case 70 is connected to the inner surface of the cover 38 of the housing 26 (FIG. 3). A cover plate 72 (FIGS. 3, 6, 7 and 10) encloses the components of the mechanism 34 within the case, but the cover plate 72 is shown broken away in FIG. 6 to illustrate the internal components of the mechanism 34. The retaining projection 46 and the adjacent portions of the holding pawl 48 extend through a slot 71 in the cover plate 72 (FIG. 3).

One pivotal end 73 of the holding pawl 48 is pivotally connected to the case 70 by a pivot pin 74. The retaining projection 46 extends outward near the other movable end 75 of the holding pawl 48. The holding pawl is preferably constructed of semi-rigid material such as 30% glass filled polyether imide. This type of material permits enough flexure to allow the ammunition belt to release if the ammunition belt is pulled on in an unexpected aggressive manner, or if the retaining projection 46 of the holding pawl 48 is inappropriately forced down on the middle of a simulated ammunition round 42. The flexure of the holding pawl ensures that the internal components of the capture and release mechanism 34 are not broken in either that these types of adverse events occur.

A cam pin 76 extends transversely out of the movable end 75 of the holding pawl 48. The cam pin 76 contacts and moves along two ramps 78 located on opposite sides of the free end of the holding pawl 48. The ramps 78 are connected to and extend from an actuation plate 80. The actuation plate 80 is confined by a guide 82 to move within the case 70 in a direction parallel to the longitudinal dimension of the holding pawl 48 toward and away from the pivotal end 73 of the holding pawl 48.

The actuation plate 80 and its attached ramps 78 move as a result of the relative pivoting movement of a pair of linkage arms 90 and 92. One end of the linkage arm 90 is pivotally connected at a stationary position to the case 70. The other end of the linkage arm 90 and one end of the linkage arm 92 are connected together at 88. The other end of the linkage arm 92 is pivotally connected to the actuation plate 80.

When the linkage arms 90 and 92 are pivoted into substantial linear alignment with one another (FIGS. 8 and 9), the actuation plate 80 is extended a maximum distance from the pivot pin 74 at the pivotal end 73 of the holding pawl 48. Movement of the actuation plate 80 to this position causes the cam pin 76 to ride upward on inclined surfaces 93 of the ramps 78 in a cam-like manner to reach a position on flat surfaces 94 of ramps 78. The flat surfaces 94 are extend generally parallel to the direction of movement of the actuation plate 80 and the ramps 78. With the cam pin 76 on the flat surfaces 94 the retaining projection 46 is extended to the maximum distance and projects between the two simulated rounds 42 in the simulated ammunition belt 22 to thereby hold the belt 22 in the feedway 24 (FIG. 7).

When linkage arms 90 and 92 are angularly articulated with respect to one another (FIGS. 6, 11 and 12), the actuation plate 80 is moved toward the pivot pin 74 at the pivotal end 73 of the holding pawl 48. Movement of the actuation plate 80 to this position causes the cam pin 76 to move off of the flat surfaces 94 and down along the inclined surfaces 93 of the ramps 78 to reach a position adjacent to the actuation plate 80. With the cam pin 76 adjacent to the actuation plate 80, the retaining projection 46 is withdrawn from between the two simulated rounds 42 in the simulated ammunition belt 22, thereby releasing the belt 22 from the feedway 24 (FIG. 10) and allowing the spring 36 to retract the belt 22 into the ammunition box 28 (FIG. 4).

Figure 8:
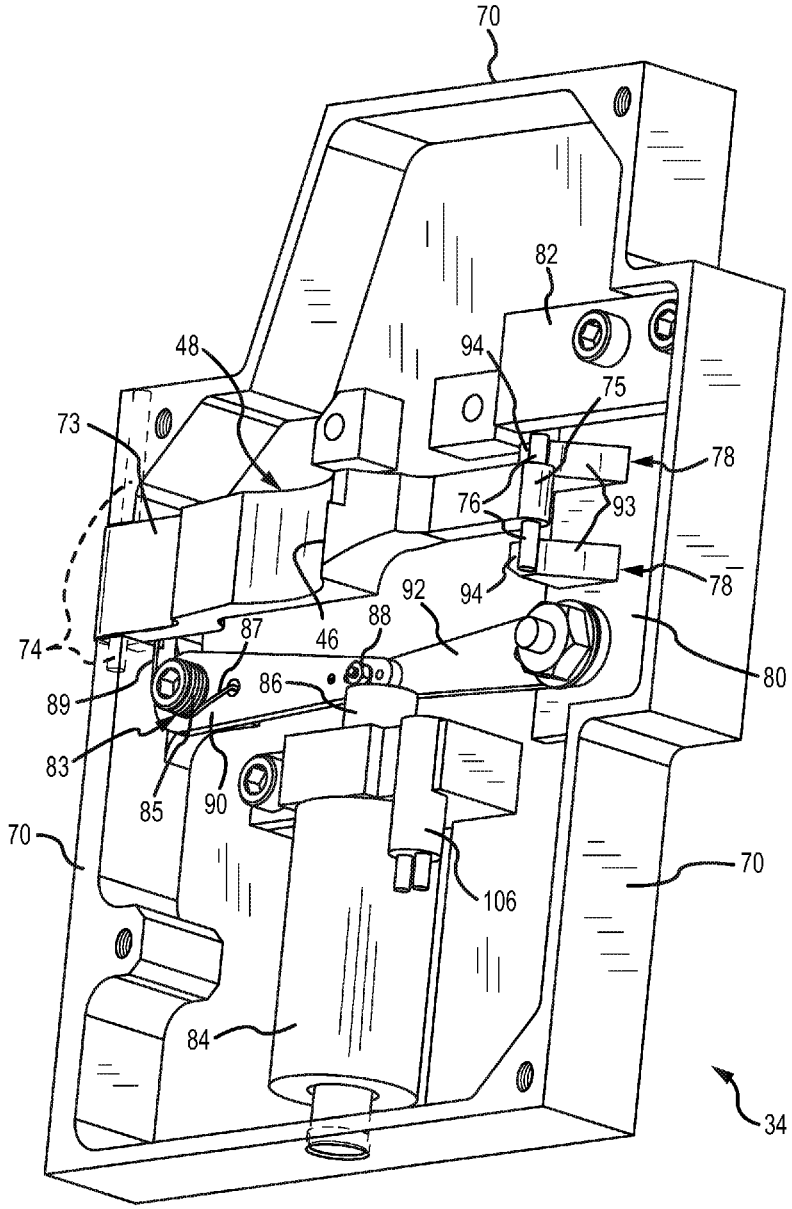
FIG. 8 is a perspective view of components of the ammunition belt capture and release mechanism shown in FIG. 6, with the holding pawl positioned to capture and hold the simulated ammunition belt as shown in FIG. 7.
Figure 9:
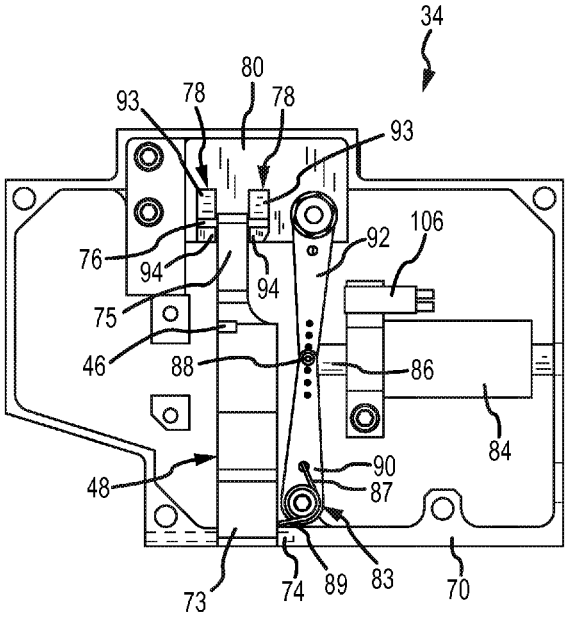
FIG. 9 is a plan view of the ammunition belt capture and release mechanism shown in FIG. 6, with components shown in the position illustrated in FIGS. 7 and 8.

The linkage arms 90 and 92 are normally pivoted into substantial linear alignment with one another (FIGS. 8 and 9) as a result of torsional bias applied by a torsion spring 83. The torsion spring 83 is mounted with its winding coils 85 surrounding a shoulder bolt that pivotally connects the end of the linkage arm 90 to the case 70. One arm 87 of the torsion spring 83 extends from the winding coils 85 and connects to a hole in the linkage arm 90. Another arm 89 extends from the winding coils 85 and contacts the case 70 at its interior sidewall. Torsion force resulting from the rotating the winding coils 85 biases the linkage arm 90 into the normal position in which it is substantially linearly aligned with the other linkage arm 92, as shown in FIGS. 8 and 9.

In the normal position of the linkage arms 90 and 92, the bias force from the torsion spring 83 positions the flat surface 94 of each ramp 78 in contact with the cam pin 76 at the movable end 75 of the holding pawl 48. The cam pin 76 rests on the flat surfaces 94 of the ramps 78, causing the vibration from the recoil impacts to have no significant detrimental effect in changing the support for the movable end 75 of the holding pawl 48. The torsional force from the torsion spring 83 maintains the linkage arms 90 and 92 in the substantially aligned orientation, even in response to the vibration from the recoil impacts. Vibration from the recoil impacts is transferred from the flat surfaces 94 of the ramps 78 to the cam pin 76. The perpendicular force on the flat surfaces 94 has no effect in moving the actuation plate 80. Consequently, the actuation plate 80 remains in place under the operative bias force from the torsion spring 83, and the retaining projection 46 remains firmly extended between the two rounds of the simulated ammunition belt 22, without risk of premature release of the simulated ammunition belt 22 due to vibration from the recoil impacts.

Any forces that attempt to move the retaining projection 46 out of contact with the simulated rounds of the ammunition belt (FIG. 7) are forces that would pivot the holding pawl 48 into the case 70. These forces are effectively resisted by the cam pin 76 resting on the flat surfaces 94 of the ramps 78. The aligned linkage arms 92 and 94 are capable of resisting substantial force applied on the ramps 72 which might tend to move the actuating plate 80 and release the ammunition belt 22 prematurely. In essence, the combination of the cam pin 76 resting on the flat surfaces 94 of the ramps 78 and the resistance to movement of the actuation plate 80 by the linearly oriented linkage arms 90 and 92, makes it almost impossible for external forces to cause the simulated ammunition belt to be released prematurely before the predetermined number of simulated rounds of the belt have been fired simulatively.

Figure 6:
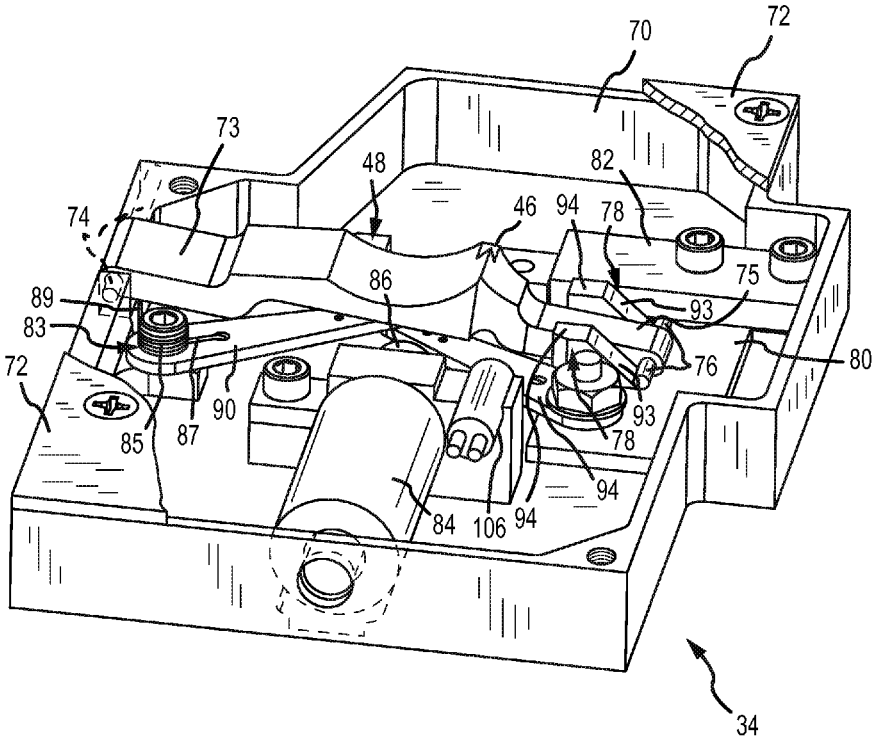
FIG. 6 is an enlarged perspective view of the ammunition belt capture and release mechanism shown in FIG. 3, with a cover plate shown broken away and with the mechanism shown as viewed from behind an open cover of the housing of the machine gun.
Figure 12:
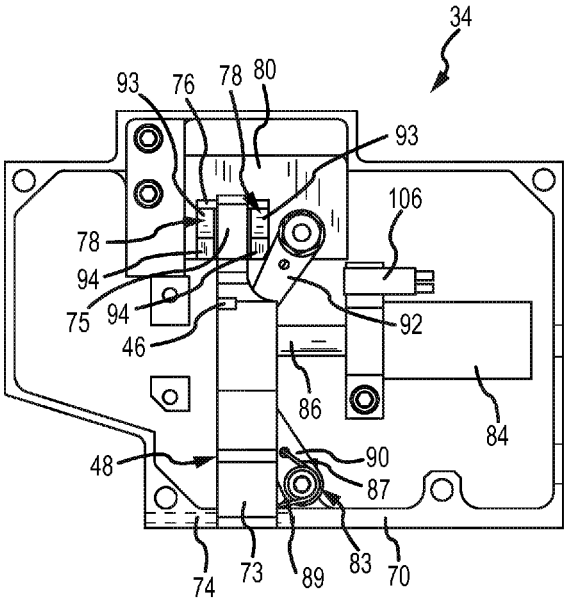
FIG. 12 is a plan view of the ammunition belt capture and release mechanism shown in FIG. 6, with the holding pawl shown in the position illustrated in FIGS. 10 and 11.
Figure 11:
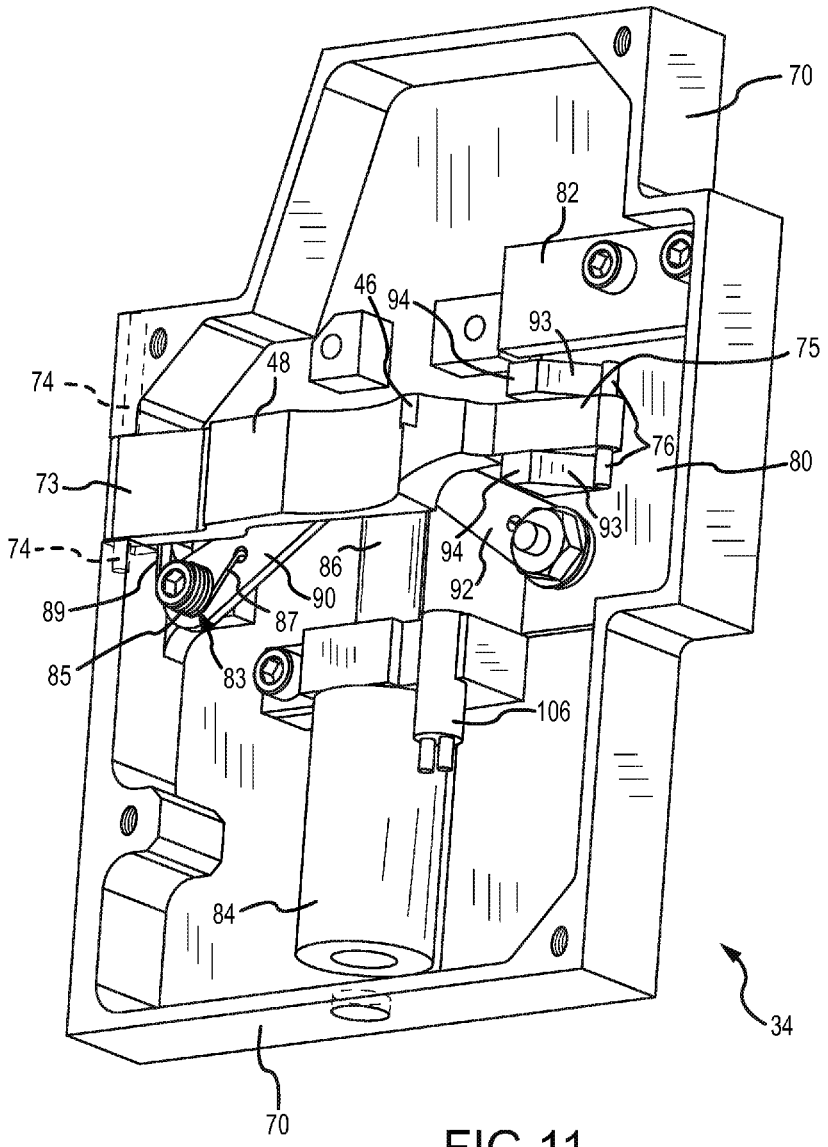
FIG. 11 is a perspective view of components of the ammunition belt capture and release mechanism shown in FIG. 6, with the holding pawl positioned to release the simulated ammunition belt as shown in FIG. 10.

A solenoid 84 is energized to release the simulated ammunition belt 22. The solenoid 84 includes an armature 86 which extends when the solenoid 84 is energized. The extension of the armature 86 contacts one or both of the linkage arms 90 and 92 near their connection 88. The extension of the armature 86 overcomes the torsional force from the torsion spring 83 and angularly articulates the linkage arms 90 and 92 with respect to one another (FIGS. 6, 11 and 12). The angularly articulated linkage arms 90 and 92 move the actuation plate 80 toward the pivot pin 74, and the cam pin 76 moves off of the flat surfaces 94 and down along the inclined surfaces 93 of the ramps 78. The holding pawl 48 pivots and the retaining projection 46 is withdrawn from between the two simulated rounds 42 in the simulated ammunition belt 22 (FIG. 10), thereby releasing the belt 22 in the feedway 24. Because of the mechanical advantages of the two articulated linkage arms 90 and 92 and the camming effect of the cam pin 76 moving down the inclined surfaces 93 of the ramps 78, the pivoting movement of the holding pawl 48 promotes the quick and reliable release of the simulated ammunition belt 22.

Only a momentary energization of the solenoid 84 is necessary to release the simulated ammunition belt. The force from the armature 86 articulates the linkage arms 90 and 92 sufficiently to develop enough force for moving the flat surfaces 94 of the ramps 78 away from the cam pin 76. Any force on the retaining projection 46 of the holding pawl 48 assists in moving the activation plate 80 by urging the cam pin 76 downward along the inclined surfaces 93 of the ramps 78, thereby further facilitating movement of the actuating plate. Consequently, a relatively small solenoid 84 is effectively employed in the ammunition belt capture and release mechanism 34 to develop sufficient force to reliably hold the ammunition belt until it is intended to be released. The small size of the solenoid 84 allows it to be integrated within the capture and release mechanism 34 located at the interior of the cover 38 of the imitation machine gun (FIG. 3).

The above described substantial alignment of the linkage arms 90 and 92 includes an orientation where the linkage arms are positioned slightly over-center in the normal position established by the torsion spring 83. The over-center position occurs when the point of connection at 88 of the ends of the linkage arms 90 and 92 is transversely offset toward the armature 86 of the solenoid 84 relative to a linear reference between the pivot points where the linkage arm 90 is pivotally connected at a stationary position to the case 70 and where the linkage arm 92 is pivotally connected to the actuation plate 80. The preferred amount of over-center offset is relatively small, for example approximately 3° of angular orientation of each linkage arm 90 and 92 relative to the linear reference. However, that over-center offset causes force transferred from the spring 36 in the ammunition box 28 (FIG. 5) through the simulated rounds 42 of the ammunition belt 22 to the retaining projection 46 of the holding pawl 48 (FIG. 7) to hold the holding pawl 48 in position with the retaining projection 46 locked in position to retain the ammunition belt in the feedway. The relatively slight 3° over-center orientation of the linkage arms 90 and 92 in the normal position also provides a mechanical advantage of approximately 25 to 1 as a force multiplier for the solenoid 84 when extending the armature 86 to pivotally each arms 90 and 92 and thereby release the ammunition belt.

The reliable holding capability of the capture and release mechanism 34 is important in the imitation machine gun 20 because a recoil simulation device 96, shown in FIG. 2, simulates firing each ammunition round by shaking or reciprocating the imitation machine gun 20 in a forward and backward motion. The recoil simulation device 96 generates substantial impacts that shake the imitation machine gun 20 to simulate firing each round 42 from the belt 22. The substantial nature of these recoil impacts have the tendency to shake the ammunition belt enough to cause a premature release in the prior art devices, as described above. Unlike the typical prior art mechanism, the ammunition belt capture and release mechanism 34 has the capability of withstanding such forces. Locating the belt capture and release mechanism 34 within the feedway 24 by attaching the mechanism 34 to the cover 38 (FIG. 3), constrains the simulated ammunition belt to prevent it from vibrating out of contact with the retaining projection 46 of the holding pawl 48. The feed tray 40 and the cover plate 72 of the belt capture and release mechanism 34 (FIGS. 3 and 7) confine the rounds 42 of the simulated ammunition belt 22 in the feedway 24 and prevent them from vibrating away from the retaining projection 46 of the holding pawl 48 (FIG. 7).

To accommodate recoil simulation, the machine gun 20 is supported by a split cradle assembly 98 which mounts the gun 20 to a support pedestal 100, as shown in FIGS. 1 and 2. The support pedestal 100 is attached to a floor or other support structure which emulates the actual environment in which the actual machine gun will be used, for example an opening in the side of a helicopter fuselage. The split cradle assembly 98 is formed by an upper movable cradle piece 102 and a separate lower stationary cradle piece 104. The gun 20 is rigidly attached to the movable piece 102, and the stationary piece 104 is rigidly attached to the pedestal 100. The recoil simulation device 96 is operatively connected to create relative movement between the movable and stationary pieces 102 and 104, thereby simulating the recoil impact associated with firing an actual machine gun. An example of a recoil simulation device 96 is described in the first above-referenced US patent application. An actual machine gun is supported by a integral cradle assembly formed as a single unitary piece.

Each individual recoil impact from of the recoil simulation device 38 is sensed and counted to determine the number of simulated rounds fired from the simulated ammunition belt. Once the number of simulated rounds fired equals the number of rounds in an actual ammunition belt, the solenoid 84 is energized and the retaining projection 46 withdraws from the space between the ammunition rounds of the ammunition belt (FIG. 10), thereby releasing the ammunition belt. The same or another simulated ammunition belt must thereafter be loaded to continue use of the imitation machine gun 20. A sensor 106, shown in FIGS. 6, 8, 9, 11 and 12 is located within the belt capture and release mechanism 34 to sense the position of a simulated round 42 once the ammunition belt 22 has been properly loaded. The signal from the sensor 106 enables the operation of the gun 20.

Figure 13:
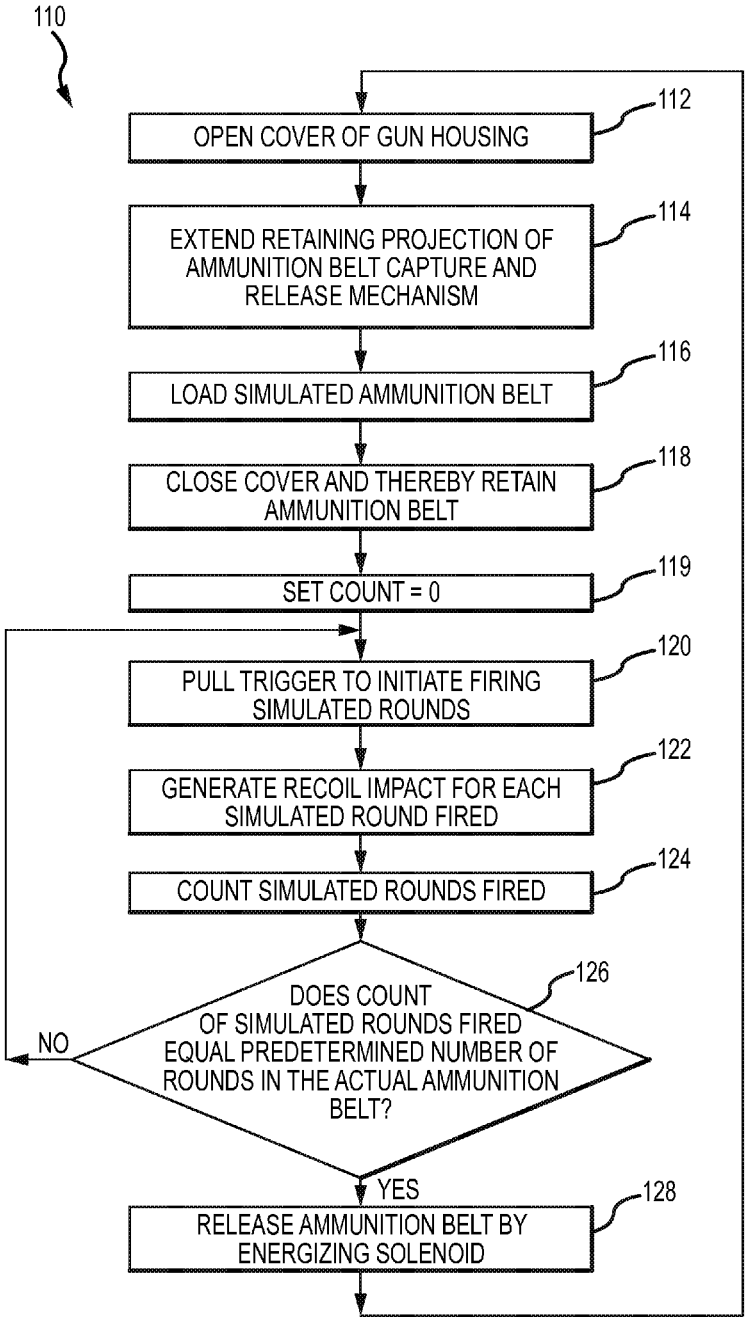
FIG. 13 is a flowchart of a sequence of actions performed by a user and by the ammunition belt capture and release mechanism shown in FIGS. 3 and 6-12, when using the imitation machine gun shown in FIGS. 1 and 2.

A sequence 110 of events which summarize the previously described use and functionality of the ammunition belt capture and release mechanism 34 in the imitation machine gun 20 is shown in FIG. 13. The sequence 110 begins when the cover 38 of the housing 26 of the machine gun 20 is opened (FIG. 3), as shown at 112. At 114, the torsional spring 83 has moved the linkage arms 90 and 92 into the aligned relationship (FIGS. 8 and 9) and the flat surfaces 94 of the ramps 78 have moved under the cam pin 76, thereby extending the retaining projection 46 of the holding pawl 48 (FIG. 7). Next, at 116, the simulated ammunition belt 22 is loaded into the feed tray 40. The cover 38 is then closed at 118, causing the retaining projection 46 of the holding pawl 48 to extend into the space between the two leading rounds 42 of the simulated ammunition belt 22, thereby retaining the ammunition belt 22 in the feedway 24 (FIG. 7). The sensor 106 (FIGS. 6, 8 and 11) senses the position of the leading round 42, to establish that the simulated ammunition belt has been correctly loaded. The signal from the sensor 106 resets a counter to zero at 119. The counter counts the number of rounds which are fired simulatively from the loaded ammunition belt. The signal from the sensor 106 also enables the gun 20 for firing.

Pulling the trigger at 120 activates the recoil simulator device 96 (FIG. 2) to generate a recoil impact from the gun 20 for each simulated round of ammunition fired while the trigger is depressed, as shown at 122. The number of simulated rounds fired from the ammunition belt is counted at 124, by counting the number of recoil impacts generated by the recoil simulator device 96. Each simulated round fired increments the counter which was reset at 119. Because the number of simulated rounds of the ammunition belt is known, the count of fired ammunition rounds at 124 is compared to the number of known rounds in the ammunition belt at 126. So long as the number of counted ammunition rounds at 124 is less than the predetermined number of rounds of the ammunition belt, the process reverts to 120, where continued depression of the trigger results in firing more simulated rounds at 122 and in incrementing the counter at 124.

Whenever the number of counted rounds at 124 equals the predetermined number of rounds of an actual ammunition belt, as determined at 126, the simulated ammunition belt 22 is released by energizing the solenoid 84 of the ammunition belt capture and release mechanism 34, as shown at 128. The operator is thereafter required to load a new simulated ammunition belt, or reload the just released ammunition belt, to enable further use of the gun 20, as shown by the process 110 reverting back to the action at 112. The same process 110 thereafter continues with the newly loaded simulated ammunition belt. Although not shown in FIG. 13, the release of the simulated ammunition belt 128 is accompanied almost simultaneously by releasing the bolt of the imitation machine gun to allow the bolt to move forward from the force of the compressed bolt actuating spring, thereby requiring the bolt to be charged before firing simulated rounds from a newly-loaded to simulated ammunition belt.

The ammunition belt capture and release mechanism 34 is capable of long-term, intensive, reliable use without premature or unexpected failure, thereby facilitating effective training with the imitation machine gun. The ammunition belt capture and release mechanism 34 overcomes the unreliable operation of the prior art device, avoids the premature release of the ammunition belt prior to firing the anticipated number of simulated rounds from the simulated ammunition belt, and avoids a loss of coordination among the control systems in the training simulator resulting from a premature and erratic release of the ammunition belt during training. As a consequence, the training with the imitation machine gun is more effective and realistic, and the individuals trained are more capable of properly operating the actual machine gun in actual circumstances.

The ammunition belt capture and release mechanism 34 is concealed and functional within the imitation machine gun 20 in a way which does not create significant differences in functionality, performance, and the look and feel of the imitation machine gun compared to the actual machine gun. No external or additional parts appear on the imitation machine gun to otherwise create differences between the use of the imitation machine gun and the use of the actual machine gun. The imitation machine gun creates substantially the same experience as using the actual machine gun. Other advantages and improvements will become apparent upon gaining a full appreciation of the present invention.

The detail of the above description constitutes a description of a preferred example of implementing the invention, and the detail of this description is not intended to limit the scope of the invention except to the extent explicitly incorporated in the following claims. The scope of the invention is defined by the following claims.

The invention claimed is:

1. An ammunition belt capture and release mechanism for an imitation machine gun which has a housing defining a feedway into which a simulated ammunition belt is loaded when using the gun, the simulated ammunition belt having a plurality of simulated ammunition rounds located in a parallel and spaced-apart relationship, the housing of the gun including a cover which is movable to an open position to permit access to the feedway for loading the simulated ammunition belt and which is movable to a closed position to confine simulated ammunition rounds of the simulated ammunition belt in the feedway, the ammunition belt capture and release mechanism comprising:

a retaining projection which is operatively connected to the cover to move selectively into an extended position and into a retracted position when the cover is in the closed position, the extended position locating the retaining projection in a space between two adjacent simulated rounds within the feedway to retain the simulated ammunition belt in the feedway, the retracted position withdrawing the retaining projection from the space between the two adjacent simulated rounds to release the simulated ammunition belt from within the feedway; and wherein:

the ammunition belt capture and release mechanism is attached to the cover at a position to move the retaining projection into adjacency with the two simulated rounds of the simulated ammunition belt loaded into the feedway when the cover is in the closed position; and the ammunition belt capture and release mechanism is substantially concealed within the housing of the gun when the cover is in the closed position.

2. An ammunition belt capture and release mechanism as defined in claim 1, further comprising:

a solenoid operatively connected to move the retaining projection from a first end to at least one of the extended and retracted positions.

3. An ammunition belt capture and release mechanism as defined in claim 1, further comprising:

a biasing member operatively connected to bias the retaining projection into the extended position.

4. An ammunition belt capture and release mechanism as defined in claim 3, further comprising:

a solenoid operatively connected to move the retaining projection from the extended position to the retracted position.

5. An ammunition belt capture and release mechanism as defined in claim 1, further comprising:

an elongated holding pawl having first and second opposite ends, the first end is pivotally connected to pivot the holding pawl at a stationary position, the second end moves in an arc about the first end when the holding pawl pivots; and wherein:

the retaining projection extends from the holding pawl.

6. An ammunition belt capture and release mechanism as defined in claim 5, wherein:

the retaining projection extends from the holding pawl at a position between the first and second ends.

7. An ammunition belt capture and release mechanism as defined in claim 5, further comprising:

a movably positioned ramp having an inclined surface; and wherein:

the ramp moves relative to the second end of the holding pawl; and the inclined surface of the ramp operatively interacts with the second end of the holding pawl during movement of the ramp to pivot the holding pawl about the first end and move the retaining projection between the extended and retracted positions.

8. An ammunition belt capture and release mechanism as defined in claim 7, wherein:

the ramp includes a flat surface extending from the inclined surface;

the top surface operatively interacting with the second end of the holding pawl to maintain the retaining projection in the extended position upon movement of the ramp into a first position; and the inclined surface operatively interacting with the second end of the holding pawl to move the retaining projection to the retracted position upon movement of the ramp to a second position displaced from the first position.

9. An ammunition belt capture and release mechanism as defined in claim 8, further comprising:

a linkage arm operatively connected to the ramp for moving the ramp into and between the first and second positions.

10. An ammunition belt capture and release mechanism as defined in claim 9, further comprising:

a biasing member operatively connected to the linkage arm to bias the linkage arm for moving the ramp into the first position; and a motive power source operatively connected to interact with the linkage arm to move the ramp from the first position to the second position.

11. An ammunition belt capture and release mechanism as defined in claim 8, further comprising:

first and second elongated linkage arms, each of the first and second linkage arms each having first and second opposite ends, the first end of the first linkage arm is connected to pivot about a stationary position, the second end of the first linkage arm and the first end of the second linkage arm are pivotally connected together to pivot the first and second linkage arms relative to one another, the second end of the second linkage arm is pivotally and operatively connected to the ramp, and wherein:

relative pivoting movement of the first and second linkage arms into a substantially aligned position locates the ramp in the first position; and relative pivoting movement of the first and second linkage arms into an angularly articulated position locates the ramp in the second position.

12. An ammunition belt capture and release mechanism as defined in claim 11, further comprising:

a biasing member operatively connected to one of the first and second linkage arms to bias the linkage arms into the substantially aligned position; and a motive power source operatively connected to interact with at least one of the first and second linkage arms to move the linkage arms into the angularly articulated position.

13. An ammunition belt capture and release mechanism as defined in claim 12, wherein:

the ramp constitutes a first ramp; and further comprising:

a second ramp having an inclined surface and a flat surface which are of substantially the same configuration as the inclined surface and the flat surface of the first ramp;

an actuation plate to which the first and second ramps are connected for operative interaction with the second end of the holding pawl, the actuation plate is operatively retained for movement toward and away from the first end of the holding pawl;

a cam pin having opposite ends which extend transversely from opposite sides of the second end of the holding pawl; and wherein:

the opposite ends of the cam pin simultaneously contact the flat and inclined surfaces of the first and second ramps; and the second end of the second leakage arm is pivotally connected to the actuation plate to move the actuation plate and the connected ramps into the first and second positions upon pivoting movement of the first and second linkage arms into the substantially aligned and angularly articulated positions, respectively.

14. A method of selectively capturing a simulated ammunition belt loaded in a feedway of a housing of an imitation machine gun and selectively releasing the simulated ammunition belt from the feedway during use of the gun, the simulated ammunition belt having simulated ammunition rounds retained in a parallel and spaced apart relationship in the belt, the gun including a cover which is movable to an open position to permit access into the feedway for loading the simulated ammunition belt into the feedway and which is moveable to a closed position when the gun is used; the method comprising:

operatively attaching a retaining projection to the cover in a position to be substantially concealed within the housing of the gun when the cover is in the closed position;

selectively extending the retaining projection into a space between two adjacent simulated rounds of the simulated ammunition belt in the feedway to capture the simulated ammunition belt within the feedway when the cover is in the closed position; and selectively retracting the retaining projection from the space between the two adjacent rounds of the simulated ammunition belt in the feedway to release the simulated ammunition belt from within the feedway when the cover is in the closed position.

15. A method as defined in claim 14, further comprising:

extending the retaining projection from a holding pawl;

operatively pivotally connecting the holding pawl to the cover; and pivoting the holding pawl to extend and retract the retaining projection.

16. A method as defined in claim 15, further comprising:

camming the holding pawl to pivot the holding pawl to extend and retract the retaining projection.

17. A method as defined in claim 16, wherein the holding pawl is elongated and has first and second opposite ends, and the method further comprises:

pivotally connecting the first end of the holding pawl at a stationary position relative to the cover; and camming the second end of the holding pawl to pivot the holding pawl about the first end and extend and retract the retaining projection.

18. A method as defined in claim 17, further comprising:

operatively attaching a movably positioned ramp to the cover;

moving the ramp relative to the cover, the ramp including an inclined surface and a flat surface extending from the inclined surface in a direction generally parallel to the movement of the ramp; and camming the second end of the holding pawl by interacting the flat surface with the second end of the holding pawl to selectively extend the retaining projection into the space between the two adjacent simulated rounds and by interacting the inclined surface with the second end of the holding pawl to selectively retract the retaining projection from the space between the two adjacent simulated rounds.

19. A method as defined in claim 18, further comprising:

maintaining the retaining projection in the extended position by contacting the second end of the holding pawl with the flat surface of the ramp.

20. A method as defined in claim 18, further comprising:

pivotally connecting a first end of a first linkage arm stationarily relative to the cover;

pivotally connecting together a second end of the first linkage arm and a first end of the second linkage arm;

pivotally connecting a second end of the second linkage arm to the ramp;

pivoting the first and second linkage arms into a substantially aligned position to interact the flat surface of the ramp with the second end of the holding pawl to extend the retaining projection; and pivoting the first and second linkage arms into an angularly articulated position to interact the inclined surface of the ramp with the second end of the holding pawl to retract the retaining projection.

21. A method as defined in claim 20, further comprising: interacting a motive power source with at least one of the first and second linkage arms to move the linkage arms from the substantially aligned position to the angularly articulated position.

* * * * *